US007159973B2

(12) United States Patent
Buchanan et al.

(10) Patent No.: US 7,159,973 B2
(45) Date of Patent: Jan. 9, 2007

(54) LATCH RELEASE MECHANISM FOR PRINTING APPARATUS COMPONENTS

(75) Inventors: Jeffery James Buchanan, Lexington, KY (US); Steven Robert Komplin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 281 days.

(21) Appl. No.: 10/865,631

(22) Filed: Jun. 10, 2004

(65) Prior Publication Data

US 2005/0275700 A1 Dec. 15, 2005

(51) Int. Cl.
*B41J 2/175* (2006.01)

(52) U.S. Cl. ..... 347/85; 347/20

(58) Field of Classification Search ..... 347/37, 347/49, 84–87, 20; 400/663
See application file for complete search history.

(56) References Cited

U.S. PATENT DOCUMENTS 6,361,158 B1 3/2002 Inoue et al. ..... 347/86
6,375,315 B1 * 4/2002 Steinmetz et al. ..... 347/86
6,502,917 B1 1/2003 Shinada et al. ..... 347/86
6,502,931 B1 1/2003 Udagawa et al. ..... 347/86
6,539,985 B1 4/2003 Shinada et al. ..... 347/86

* cited by examiner

*Primary Examiner*—Juanita D. Stephens
(74) *Attorney, Agent, or Firm*—Taft, Stettinium & Hollister LLP

(57) ABSTRACT

A replacement component for printing operations that includes a recess that is adapted to be engaged by a projection of a replacement component holder associated with a printing apparatus to mount the replacement component to the replacement component holder, the replacement component also including an actuatable release adapted to operatively contact at least one of the projection and the recess to substantially disengage the projection from the recess. The invention also includes a method of manipulating the extraction force associated with a replacement component of an inkjet printer comprising the step of displacing a retainer operative to maintain the relative position of a first printing apparatus component with respect to a second printing apparatus component by selectively contacting a mechanical release therewith to disengage the retainer and thereby allowing the first printing apparatus component to be repositioned with respect to the second printing apparatus component, wherein the mechanical release is associated with one of the first printing apparatus component and the second printing apparatus component.

86 Claims, 4 Drawing Sheets

LATCH RELEASE MECHANISM FOR PRINTING APPARATUS COMPONENTS

BACKGROUND

1. Field of the Invention

The present invention is directed to engagement and disengagement mechanisms for replaceable components and, more specifically, to engagement and disengagement mechanisms incorporated into printing apparatus components. In addition, the invention relates to improving the customer experience when installing and removing replaceable ink tanks in either an on-carrier or off-carrier system.

2. Background of the Invention

Inkjet ink reservoirs are usually a separate ink tank or part of a disposable printhead. A removable ink tank should be relatively easy for end users to install and remove when replacement is warranted. The forces associated with removal and insertion of the ink tanks and replacement printheads are commonly referred to as the human factor limits. Forces outside of the human factors limits are considered undesirable from a customer satisfaction perspective correlating to ease of use.

Ink tank retention features, electrical connections, and fluidic connections are generally with the printhead, the carrier, or the off-carrier receptacle. Snaps or detents are generally employed as retention features, which can cause difficulty in installing or removing tanks due to substantial insertion and removal forces. Latch forces need to be high enough to counteract any handling, dynamic motion, fluid connection, memory module, or spring assist ejection forces.

FIG. 9 shows a prior art depiction of a detent system 100. During insertion, the detents 102 are forced out of the way by the tank 104. The insertion ramp 106 and spring geometry help minimize the insertion forces to latch the tank 104 in place. The forces involved in the interface area 108 are not affected by the ramp 106. The additional forces in this area are due to memory module connections, fluidic connections, and any tank release springs (not shown). These additional forces are important in sizing the amount of force that will be necessary for tank removal. The latch force must be higher than these forces to make sure the tank 104 does not pop out of the tank receptacle 110.

FIG. 10 depicts a prior art graphical representation showing insertion forces/extraction forces versus tank distance. Zero distance denotes the position of the tank being received within the receptacle, which can be part of the printhead, the carrier, or the off-carrier containment system.

SUMMARY OF THE INVENTION

The present invention is directed to engagement and disengagement mechanisms for replaceable components, and more specifically to engagement and disengagement mechanisms incorporated with printing apparatus components. In addition, the invention relates to improving the customer experience when installing and removing replaceable ink tanks in either an on-carrier or off-carrier system.

It is a first aspect of the present invention to provide a replacement component for printing operations that includes a recess that is adapted to be engaged by a projection of a replacement component holder associated with a printing apparatus to mount the replacement component to the replacement component holder, the replacement component also including an actuatable release adapted to operatively contact at least one of the projection and the recess to substantially disengage the projection from the recess.

In a more detailed embodiment of the first aspect, the replacement component comprises at least one of an ink tank and a printhead. In yet another more detailed embodiment, the release is slidably repositionable with respect to the replacement component. In a further detailed embodiment, the release is slidably repositionable between a first position and a second position, the first position is adapted to not substantially disengage the projection from the recess, and the second position is adapted to substantially disengage the projection from the recess. In still a further detailed embodiment, the release is biased to the first position. In a more detailed embodiment, the release includes a handle adapted to be gripped during replacement of the replacement component, where the handle is vertically repositionable and operative to move the release between the first position and the second position. In a more detailed embodiment, one of the recess and the projection is biased toward the other. In another more detailed embodiment, the release is adapted to be repositioned in a first direction and the replacement component is adapted to be removed from the replacement component holder in the first direction. In yet another more detailed embodiment, the release includes a handle adapted to be finger gripped by a user and pulled in the first direction to remove the replacement component from the replacement component holder. In still another more detailed embodiment, the release is pivotally repositionable with respect to the replacement component.

In yet another more detailed embodiment of the first aspect, the release is pivotally repositionable between a first position and a second position, the first position is adapted to not substantially disengage the projection from the recess, and the second position is adapted to substantially disengage the projection from the recess. In a further detailed embodiment, the release includes a handle adapted to be gripped during replacement of the replacement component, where the handle is pivotally repositionable and operative to move the release between the first position and the second position.

It is a second aspect of the present invention to provide a replacement component for printing operations that includes a projection that is adapted to be engaged by a recess of a replacement component holder of a printing apparatus to mount the replacement component to the replacement component holder, the replacement component also including a release adapted to operatively contact at least one of the projection and the recess to substantially disengage the projection from the recess prior to removal of the replacement component from the replacement component holder.

In a more detailed embodiment of the second aspect, the replacement component comprises at least one of an ink tank and a printhead. In yet another more detailed embodiment, the release is slidably repositionable with respect to the replacement component. In a further detailed embodiment, the release is slidably repositionable between a first position and a second position, the first position is adapted to not substantially disengage the projection from the recess, and the second position is adapted to substantially disengage the projection from the recess. In still a further detailed embodiment, the release is biased to the first position. In a more detailed embodiment, the release includes a handle adapted to be gripped during replacement of the replacement component, where the handle is vertically repositionable and operative to move the release between the first position and the second position. In a more detailed embodiment, one of the recess and the projection is biased toward the other. In another more detailed embodiment, the release is adapted to be repositioned in a first direction and the replacement component is adapted to be removed from the replacement component holder in the first direction. In yet another more detailed embodiment, the release includes a handle adapted to be finger gripped by a user and pulled in the first direction to remove the replacement component from the replacement component holder. In still another more detailed embodiment, the release is pivotally repositionable with respect to the replacement component.

In yet another more detailed embodiment of the second aspect, the release is pivotally repositionable between a first position and a second position, the first position is adapted to not substantially disengage the projection from the recess, and the second position is adapted to substantially disengage the projection from the recess. In still another more detailed embodiment, the release is biased to the first position. In a further detailed embodiment, the release includes a handle adapted to be gripped during replacement of the replacement component, where the handle is pivotally repositionable and operative to move the release between the first position and the second position.

It is a third aspect of the present invention to provide an inkjet assembly comprising: (a) an ink reservoir; and (b) an ink reservoir holder of an inkjet printing apparatus, where one of the ink reservoir and the ink reservoir holder includes a projection, while the other of the ink reservoir and the ink reservoir holder includes a recess that is adapted to be engaged by the projection to mount the ink reservoir to the ink reservoir holder, and where one of the ink reservoir and the ink reservoir holder includes a release adapted to operatively contact at least one of the projection and the recess to substantially disengage the projection from the recess prior to removal of the ink reservoir from the ink reservoir holder.

In a more detailed embodiment of the third aspect, the ink reservoir is mounted to a printhead. In yet another more detailed embodiment, the release is adapted to be repositioned in a first direction and the ink reservoir is adapted to be removed from the ink reservoir holder in the first direction. In a further detailed embodiment, the release includes a handle adapted to be finger gripped by a user and pulled in the first direction to remove the ink reservoir from the ink reservoir holder. In still a further detailed embodiment, the ink reservoir includes the projection, the ink reservoir holder includes the recess, and the ink reservoir holder includes the release. In a more detailed embodiment, the release is slidably repositionable with respect to the ink reservoir holder. In a more detailed embodiment, the release is slidably repositionable between a first position and a second position, the first position is adapted to not substantially disengage the projection from the recess, and the second position is adapted to substantially disengage the projection from the recess. In another more detailed embodiment, the release is biased to the first position. In yet another more detailed embodiment, the release includes a handle adapted to be gripped during replacement of the ink reservoir, where the handle is repositionable and operative to move the release between the first position and the second position. In still another more detailed embodiment, one of the recess and the projection is biased toward the other.

In yet another more detailed embodiment of the third aspect, the release is pivotally repositionable with respect to the ink reservoir holder. In still another more detailed embodiment, the release is pivotally repositionable between a first position and a second position, the first position is adapted to not substantially disengage the projection from the recess, and the second position is adapted to substantially disengage the projection from the recess. In still a further detailed embodiment, the release includes a handle adapted to be gripped during replacement of the ink reservoir, where the handle is pivotally repositionable and operative to move the release between the first position and the second position. In a more detailed embodiment, the ink reservoir includes the recess, the ink reservoir holder includes the projection, and the ink reservoir holder includes the release. In another more detailed embodiment, the release is slidably repositionable with respect to the ink reservoir holder. In yet another more detailed embodiment, the release is slidably repositionable between a first position and a second position, the first position is adapted to not substantially disengage the projection from the recess, and the second position is adapted to substantially disengage the projection from the recess.

In yet another more detailed embodiment of the third aspect, the release includes a handle adapted to be gripped during replacement of the ink reservoir, where the handle is repositionable and operative to move the release between the first position and the second position. In a further detailed embodiment, the release is pivotally repositionable with respect to the ink reservoir holder. In still a further detailed embodiment, the release is pivotally repositionable between a first position and a second position, the first position is adapted to not substantially disengage the projection from the recess, and the second position is adapted to substantially disengage the projection from the recess. In a more detailed embodiment, the release includes a handle adapted to be gripped during replacement of the ink reservoir, where the handle is pivotally repositionable and operative to move the release between the first position and the second position.

It is a fourth aspect of the present invention to provide a retention and release mechanism for mounting a first constituent of a printing apparatus component to a second constituent of a printing apparatus component comprising: (a) a first printing apparatus coupling component including one of a first constituent and a second constituent; (b) a second printing apparatus coupling component including the other of the first constituent and the second constituent; and (c) a release component associated with at least one of the first coupling component and the second coupling component, where interaction between the first constituent to the second constituent is operative to mount the first printing apparatus coupling component to the second printing apparatus coupling component, and where the release component is adapted to be repositioned to operatively contact at least one of the first constituent and the second constituent to reposition the first constituent with respect to the second constituent, thereby allowing the first constituent to be disengaged from the second constituent and allowing the first printing apparatus coupling component to be disengaged from the second printing apparatus coupling component.

In a more detailed embodiment of the fourth aspect, the first printing apparatus coupling component includes an appendage, the second printing apparatus coupling component includes a concavity, the first printing apparatus coupling component includes the first constituent, the second printing apparatus coupling component includes the second constituent, and the release component is associated with the first printing apparatus coupling component. In yet another more detailed embodiment, the first printing apparatus coupling component includes an ink reservoir, and the second printing apparatus coupling component includes an ink reservoir receptacle. In a further detailed embodiment, the first printing apparatus coupling component includes a concavity, the second printing apparatus coupling component includes an appendage, the first printing apparatus coupling component includes the second constituent, the second printing apparatus coupling component includes the first constituent, and the release component is associated with the first printing apparatus coupling component. In still a further detailed embodiment, the first printing apparatus coupling component includes an appendage, the second printing apparatus coupling component includes a concavity, the first printing apparatus coupling component includes the first constituent, the second printing apparatus coupling component includes the second constituent, and the release component is associated with the second printing apparatus coupling component. In a more detailed embodiment, the second printing apparatus coupling component includes an ink reservoir receptacle, and the first printing apparatus coupling component includes an ink reservoir. In a more detailed embodiment, the first printing apparatus coupling component includes a concavity, the second printing apparatus coupling component includes an appendage, the first printing apparatus coupling component includes the second constituent, the second printing apparatus coupling component includes the first constituent, and the release component is associated with the second printing apparatus coupling component.

It is a fifth aspect of the present invention to provide a method of manipulating the extraction force associated with a replacement component of an inkjet printing apparatus, the method comprising the step of displacing a retainer operative to maintain the relative position of a first printing apparatus component with respect to a second printing apparatus component by selectively contacting a mechanical release therewith to disengage the retainer and thereby allowing the first printing apparatus component to be repositioned with respect to the second printing apparatus component, where the mechanical release is associated with one of the first printing apparatus component and the second printing apparatus component.

In a more detailed embodiment of the fifth aspect, the displacing step includes the step of displacing the retainer in a first direction allowing removal of the first printing apparatus component from the second printing apparatus component. In yet another more detailed embodiment, the retainer includes a handle adapted to be finger gripped by a user and pulled in the first direction to remove the first printing apparatus component from the second printing apparatus component. In a further detailed embodiment, the retainer includes a projection associated with the second printing apparatus component, and the mechanical release is associated with the first printing apparatus component, where the first printing apparatus component includes a recess operative to receive the projection therein. In still a further detailed embodiment, the mechanical release slides with respect to the first printing apparatus component. In a more detailed embodiment, the mechanical release pivots with respect to the first printing apparatus component. In a more detailed embodiment, the first printing apparatus component includes an ink reservoir, and the second printing apparatus component includes an ink reservoir receptacle. In another more detailed embodiment, the mechanical release is associated with the second printing apparatus component, and the retainer includes a projection associated with the second printing apparatus component and a recess associated with the first printing apparatus component operative to receive the projection therein.

In yet another more detailed embodiment of the fifth aspect, the mechanical release is associated with the first printing apparatus component, and the retainer includes a projection associated with the first printing apparatus component and a recess associated with the second printing apparatus component operative to receive the projection therein. In a further detailed embodiment, the mechanical release is associated with the second printing apparatus component, and the retainer includes a projection associated with the first printing apparatus component and a recess associated with the second printing apparatus component operative to receive the projection therein.

DETAILED DESCRIPTION

The exemplary embodiments of the present invention are described and illustrated below to encompass mating systems for mounting a first component to a second component. More specifically, the exemplary embodiments of the present invention are described and illustrated below to encompass mating systems for mounting replacement components utilized to print indicia onto a medium. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps and/or features that one of ordinary skill will recognize as not being a requisite to fall within the scope of the present invention.

Figure 1:
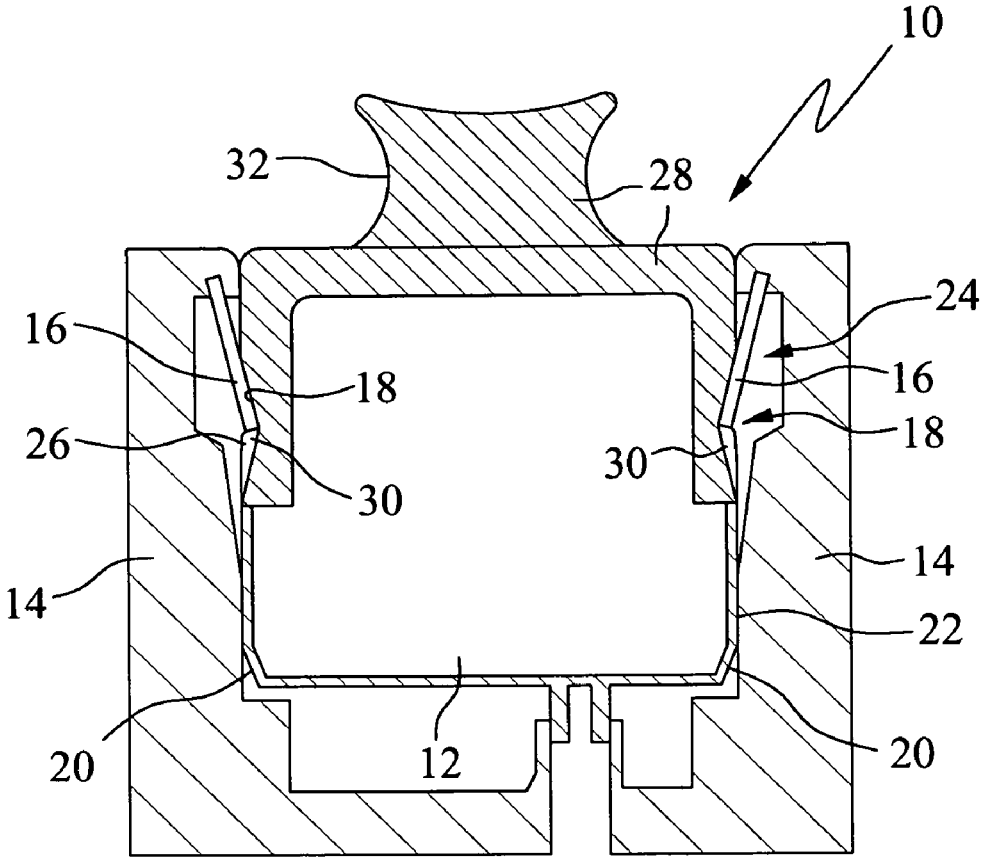
FIG. 1 is a cross sectional view of a first exemplary positive displacement release mechanism embodiment in accordance with the present invention.
Figure 2:
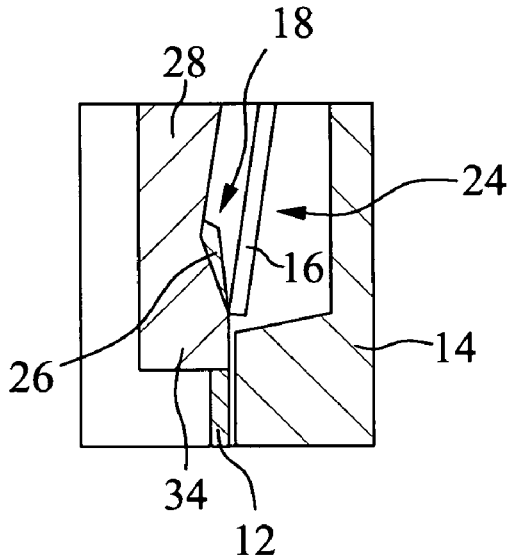
FIG. 2 is an isolated cross sectional view of the first exemplary positive displacement release mechanism embodiment in accordance with the present invention showing an ink cartridge being inserted within an ink cartridge carrier.

Referencing FIGS. 1 and 2, a first exemplary embodiment 10 of the present invention includes an ink cartridge 12 mounted to an ink cartridge carrier 14 using biased tang 16 and recess 18 systems. For the sake of simplicity, operation of the tang 16 and recess 18 systems will be described hereafter in singular fashion.

As the cartridge 12 is being mounted to the carrier 14, a beveled surface 20 of the ink cartridge 12 contacts the tang 16, thereby pushing the tang 16 out of the line of travel of the cartridge 12 so that the tang 16 rides upon an exterior surface 22 of the cartridge 12 and is substantially positioned within a cavity 24 formed within the carrier 14. The tang 16 continues to ride upon the exterior surface 22 of the cartridge until reaching the recess 18. Upon reaching the recess 18, the tang 16 is biased outward to track the exterior surface 22 thereof and become seated within the recess 18, thereby mounting the cartridge 12 to the carrier 14. The cartridge includes a flange 26 that limits the ability of the cartridge 12 to be moved in a particular direction, in this exemplary embodiment upward, that would allow disengagement between the cartridge 12 and the carrier 14.

As shown in FIGS. 1–5, the cartridge 12 includes a repositionable handle 28 that is adapted to selectively contact the tang 16 to displace the tang from the recess 18 and flange 26. This displacement of the tang 16 allows the cartridge 12 to be disengaged from the carrier 14. The handle 28 is slidably repositionable and includes a mating surface 30 that facilitates repositioning of the tang 16. This surface 30 may include a camming surface that includes arcuate or angled regions, so long as movement of the handle 28 is effective to reposition the tang 16.

Referring to FIGS. 1–5, the handle 28 is vertically slidable with respect to the body of the cartridge 12 and the ink cartridge carrier 14. The handle rides within a vertical track (not shown) molded within the exterior of the cartridge 12. The vertical track includes at least one catch (not shown) that limits the range of movement of the handle 28 with respect to the cartridge 12. When removal of the cartridge 12 is desired, a user would grasp a projection 32 of the handle and apply an upward force. This upward force would cause a base 34 of the handle 28 to be vertically repositioned with respect to the cartridge 12 and the cartridge carrier 14. As will be described below, initial lifting of the handle 28 with respect to the cartridge 12 acts to displace the tang 16; and further lifting of the handle 28 causes the handle 28 to contact the catch in the vertical track such that further lifting will pull the released cartridge 12 from the cartridge carrier 14.

Figure 3:
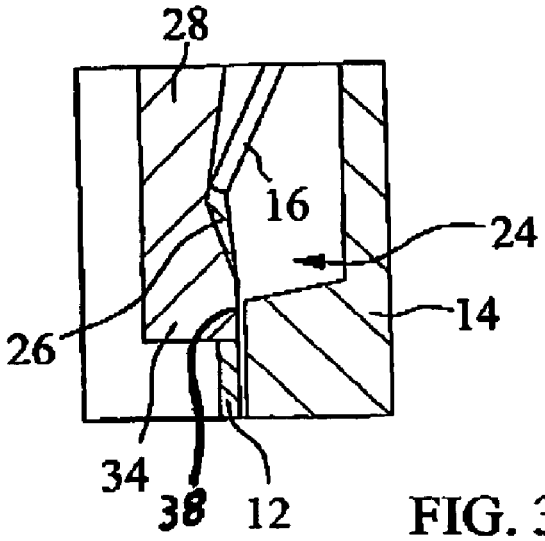
FIG. 3 is an isolated cross sectional view of the first exemplary positive displacement release mechanism embodiment in accordance with the present invention showing an ink cartridge mounted to an ink cartridge carrier.
Figure 4:
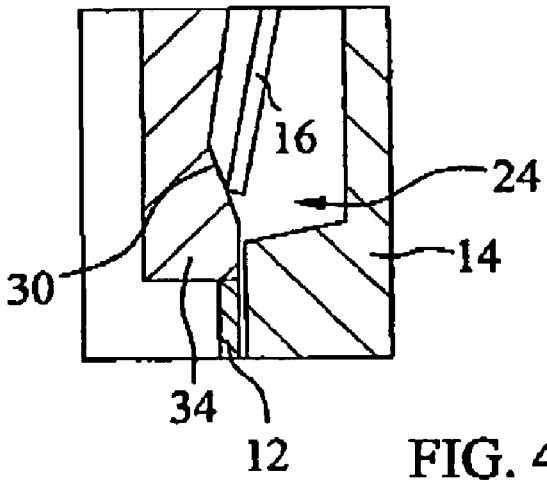
FIG. 4 is an isolated cross sectional view of the first exemplary positive displacement release mechanism embodiment in accordance with the present invention showing an early stage of an ink cartridge being removed from an ink cartridge carrier.

During removal of the cartridge 12, the base 34 would move from the position shown in FIG. 3 to the position shown in FIG. 4. In the interim between these two positions, the mating surface 30 of the handle 28 contacts the lower portion of the tang 16, such that the tang rides upon the surface 30 and transforms the vertical movement of the handle 28 into horizontal inward movement of the tang 16. The angled surface 30 the handle 28 horizontally continues to displace the tang further and further from the base of the recess 18 as the handle is moved upward. Eventually, the tang 16 approaches a transition area 36 of the surface 30 characterized by a transition into the vertical nature of the cartridge side wall 22.

Figure 5:
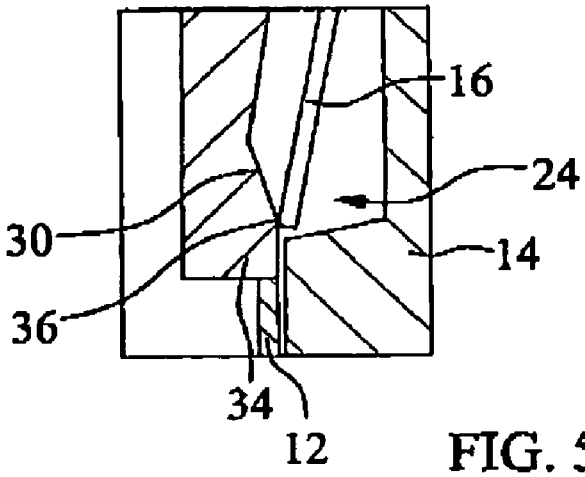
FIG. 5 is an isolated cross sectional view of the first exemplary positive displacement release mechanism embodiment in accordance with the present invention showing an intermediate stage of an ink cartridge being removed from an ink cartridge carrier.

Referencing FIGS. 3–5, as the handle is moved further upward from its position as shown in FIG. 4, the transition area 36 contacts the tang 16 and forces the tang horizontally inward from the cartridge to sufficiently clear the flange 26. Continued upward movement allows the tang 16 to ride upon a lower exterior surface 38 of the handle 28 that is equal to or extends beyond the exterior surface of the cartridge 22. Therefore, the contour of the handle 28 contacting the tang 16 maintains the tang 16 outside of the flange 26 such that interaction between the tang 16 and the flange 26 does not substantially hinder removal of the cartridge 12 from the carder 14. At this point, the handle 28 will contact the catch in the vertical track such that further lifting on the handle will pull the released cartridge 12 from the cartridge holder 14.

It is also within the scope and spirit of the present invention to provide a spring biased and/or pivotable tang 16. Still further, the present invention contemplates various retention mechanisms that may be interchangeable with those discussed in the above exemplary embodiment that include movement of a repositionable handle to disengage the retention mechanisms and enable removal of a replacement or a repositionable component, in exemplary form, discussed above as an inkjet cartridge 12.

Figure 6:
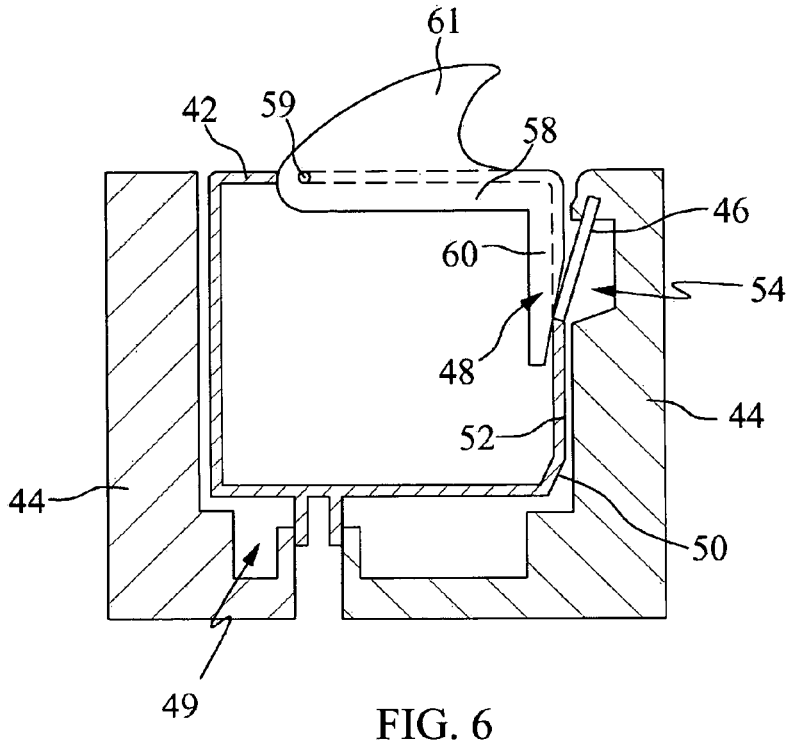
FIG. 6 is a cross sectional view of a second exemplary positive displacement release mechanism embodiment in accordance with the present invention.
Figure 7:
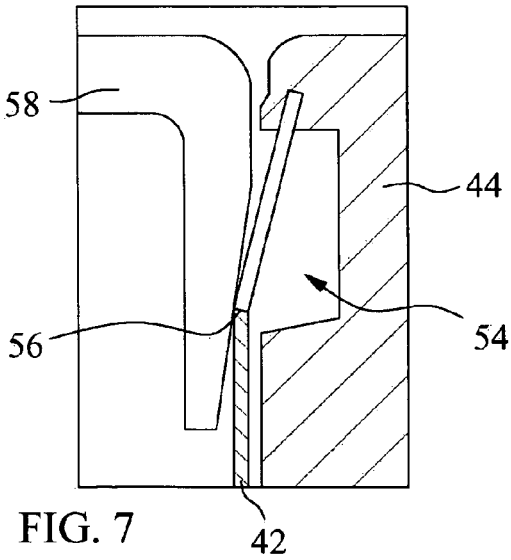
FIG. 7 is an isolated cross sectional view of the second exemplary positive displacement release mechanism embodiment in accordance with the present invention showing an ink cartridge mounted to an ink cartridge carrier.
Figure 8:
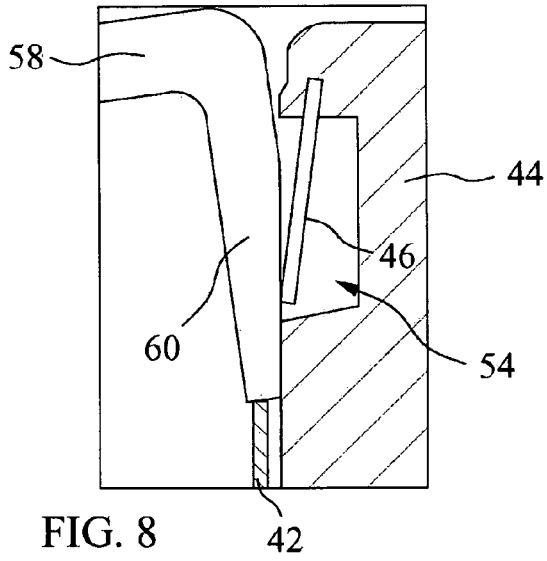
FIG. 8 is an isolated cross sectional view of the second exemplary positive displacement release mechanism embodiment in accordance with the present invention showing an intermediate stage of an ink cartridge being removed from an ink cartridge carrier.
Figure 9:
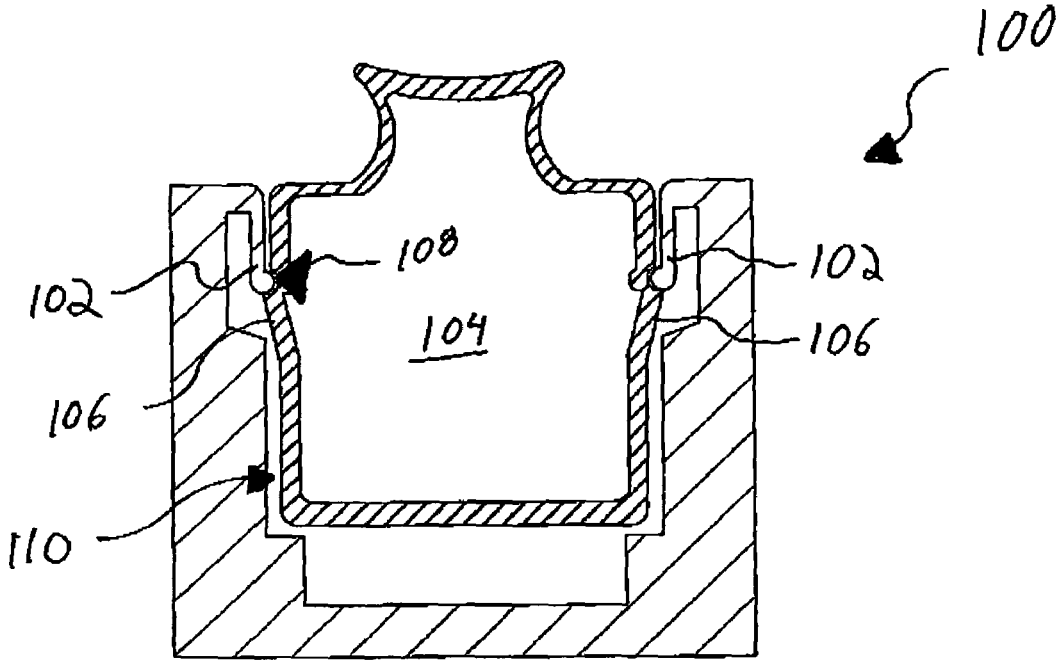
FIG. 9 (Prior Art)
FIG. 9 shows a prior art depiction of a detent release mechanism system.
Figure 10:
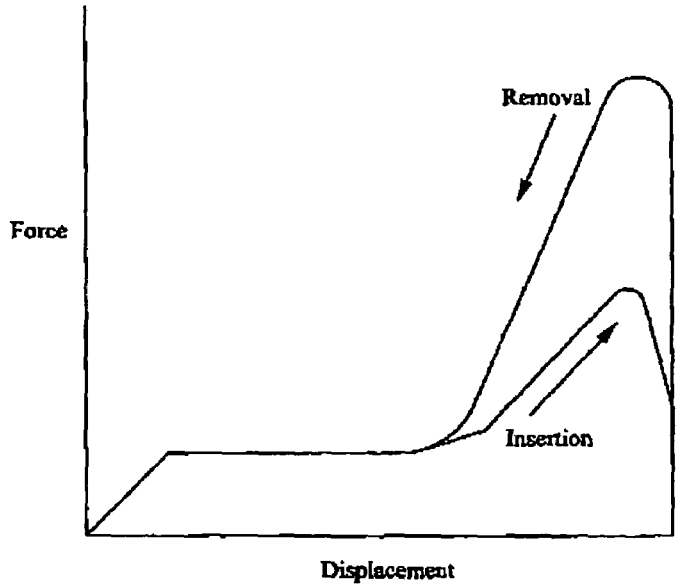
FIG. 10 (Prior Art)
FIG. 10 is a graphical depiction of prior art release mechanism systems plotting insertion forces and extraction forces versus tank distance.

Referencing FIGS. 6–8, a second exemplary embodiment 40 of the present invention includes an ink cartridge 42 adapted to be mounted to an ink cartridge carrier 44 using a biased tang 46 and notch 48 system. The ink cartridge includes a beveled surface 50 adjacent to the base thereof that transitions into an upright side surface 52 that includes the groove 48 defined in part by a lower shoulder 56. The cartridge 42 also includes a lever 58, pivotable upon a hinge 59. The lever 58 includes a gripping tab 61 and a contacting arm 60 on the same side of the hinge 59. Therefore, upon lifting of the tab 61, the lever 58 will pivot the contacting arm 60 outward, which will push the tang 46 inwardly and out of the notch 48.

To mount the cartridge 42 to the carrier, the beveled surface 50 of the ink cartridge 42 contacts the tang 46 such that the tang 46 rides upon the angled surface 50 and transforms the vertical movement of the cartridge 42 into horizontal inward movement of the tang 46. This results in the tang 46 tracking the exterior surface 52 as the cartridge 42 is moved into its mounted position. As the tang 46 rides upon the exterior surface 52, it passes over the shoulder 56 and is biased toward the cartridge 42 and received within the notch 48 to mount the cartridge 42 to the carrier 44 as shown in FIG. 7. It is intended that the fluid interconnections 49 between the cartridge 42 and the carrier 44 are fluidically sealed as the cartridge 42 is moved to its mounted position.

To disengage the cartridge 42 from the carrier 44, the lever 58 is pivotally repositioned with respect to the body of the cartridge 42. This movement of the lever 58 repositions the contacting arm 60 with respect to the notch 48 of the cartridge 42, thereby orienting the contacting arm 60 to touch the tang 46 as shown in FIG. 8. As the contacting arm 60 touches the tang 46, the tang 46 is pushed away from the cartridge 42 and continues to be pushed further toward a recess 54 within the carrier 44 as the contacting arm 60 continues to be pivoted. The tang 46 is eventually driven far enough away from the cartridge 42 by the movement of the contacting arm 60 such that the tang 46 no longer contacts the shoulder 56 or is considered to be seated within the notch 48. At this point the cartridge 42 may be vertically repositioned and moved upward (i.e., a user may pull upward on the lever), thereby maintaining the contact between the tang 46 and contacting arm 60 until the shoulder 56 passes beyond the end of the tang 46. Thereafter, the arm 60 is no longer required to be pivoted to push the tang 46 outward and the tang 46 may ride upon the exterior surface 52 while the cartridge 42 is removed, as the tang 46 has nothing to interface or grasp onto to hinder upward movement and removal of the cartridge 42 from the carrier 44.

It is also within the scope and spirit of the present invention to provide a spring biased and/or pivotable tang 46. Still further, the present invention contemplates various retention mechanisms that may be interchangeable with those discussed in the above exemplary embodiment that include movement of a repositionable handle to disengage the retention mechanisms and enable removal of a replacement or a repositionable component, in exemplary form, discussed above as an inkjet cartridge 42.

It is also within the scope of the invention that the tang 16, 46 be rigid and substantially in a static position. In such an exemplary embodiment, the corresponding feature of the recess 18 or notch 48 is biased such that contact with the handle 28 or contacting arm 60 results in displacement of the flange 26 or shoulder 56 from the tang 16, 46.

As used herein, the terms recess 18 or notch 48 may include any feature that inhibits linear movement in at least one plane. Therefore, a recess 18 or a notch 48 as used herein does not necessarily require a depression, but includes an area that has a differing topography than an adjacent feature. Such differing topographies may include several points along a planar, sloped segment as well as a basin being circumferentially surrounded by elevated features.

The above exemplary embodiments may utilize living hinges or more generally bendable and flexible components integrated with the cartridge 12, 42 or cartridge carrier 14, 44 to carry out pivoting functions. For example, the tang 16, 46 may be integrally molded to the carrier 14, 44, where the tang is able to be bent, deformed, and/or repositioned. Those of ordinary skill are aware of the obvious variations that may be made to the above exemplary embodiments to modify or include resilient materials and designs into the various exemplary components.

It is also within the scope and spirit of the present invention to utilize the novel mounting structures for mounting various components of a printing apparatus, such as a printer or multifunction device that is capable of printing operations. For instance, the above described exemplary mounting structures may be used with a laser printer toner cartridge, a replacement inkjet printhead, paper trays for a printing apparatus, and other replacement or frequently removed and reinstalled items.

Following from the above description and invention summaries, it should be apparent to those of ordinary skill in the art that, while the methods and apparatuses herein described constitute exemplary embodiments of the present invention, the invention contained herein is not limited to these exemplary embodiments and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A replacement component for printing operations comprising:

a replacement component including a boundary defining a recess that is adapted to be engaged by a projection of a replacement component holder associated with a printer to mount the replacement component to the replacement component holder, the replacement component also including an actuatable release separate from the projection and the boundary of the recess, the release being operative to selectively reposition at least one of the projection and the boundary defining the recess to substantially disengage the projection from the boundary defining the recess.

2. The replacement component of claim 1, wherein the replacement component comprises at least one of an ink tank and a printhead.

3. The replacement component of claim 1, wherein the release is slidably repositionable with respect to the replacement component.

4. The replacement component of claim 3, wherein:

the release is slidably repositionable between a first position and a second position;

the first position is adapted to not substantially disengage the projection from the recess; and the second position is adapted to substantially disengage the projection from the recess.

5. The replacement component of claim 4, wherein the release is biased to the first position.

6. The replacement component of claim 4, wherein the release includes a handle adapted to be gripped during replacement of the replacement component, where the handle is vertically repositionable and operative to move the release between the first position and the second position.

7. The replacement component of claim 4, wherein one of the recess and the projection is biased toward the other.

8. The replacement component of claim 1, wherein the release is adapted to be repositioned in a first direction and the replacement component is adapted to be removed from the replacement component holder in the first direction.

9. The replacement component of claim 8, wherein the release includes a handle adapted to be finger gripped by a user and pulled in the first direction to remove the replacement component from the replacement component holder.

10. The replacement component of claim 1, wherein the release is pivotally repositionable with respect to the replacement component.

11. The replacement component of claim 10, wherein:

the release is pivotally repositionable between a first position and a second position;

the first position is adapted to not substantially disengage the projection from the recess; and the second position is adapted to substantially disengage the projection from the recess.

12. The replacement component of claim 11, wherein the release is biased to the first position.

13. The replacement component of claim 11, wherein the release includes a handle adapted to be gripped during replacement of the replacement component, where the handle is pivotally repositionable and operative to move the release between the first position and to second position.

14. The replacement component of claim 11, wherein one of the recess and the projection is biased toward the other.

15. A replacement component for printing operations comprising:

a replacement component including a projection that is adapted to engage a boundary of a recess of a replacement component holder of a printer to mount the replacement component to the replacement component holder, the replacement component also including a release separate from the projection and the boundary of the recess, the release being operative to selectively reposition at least one of the projection and the boundary of the recess to substantially disengage the projection from the boundary of recess prior to removal of the replacement component from the replacement component holder.

16. The replacement component of claim 15, wherein the replacement component comprises at least one of an ink tank and a printhead.

17. The replacement component of claim 15, wherein the release is slidably repositionable with respect to the replacement component.

18. The replacement component of claim 17, wherein:

the release is slidably repositionable between a first position and a second position;

the first position is adapted to not substantially disengage the projection from the recess; and the second position is adapted to substantially disengage the projection from the recess.

19. The replacement component of claim 18, wherein the release is biased to the first position.

20. The replacement component of claim 18, wherein the release includes a handle adapted to be gripped during replacement of the replacement component, where the handle is vertically repositionable and operative to move the release between the first position and the second position.

21. The replacement component of claim 18, wherein one of the recess and the projection is biased toward the other.

22. The replacement component of claim 15, wherein the release is adapted to be repositioned in a first direction and the replacement component is adapted to be removed from the replacement component holder in the first direction.

23. The replacement component of claim 22, wherein the release includes a handle adapted to be finger gripped by a user and pulled in the first direction to remove the replacement component from the replacement component holder.

24. The replacement component of claim 15, wherein the release is pivotally repositionable with respect to the replacement component.

25. The replacement component of claim 24, wherein:

the release is pivotally repositionable between a first position and a second position;

the first position is adapted to not substantially disengage the projection from the recess; and the second position is adapted to substantially disengage the projection from the recess.

26. The replacement component of claim 25, wherein the release is biased to the first position.

27. The replacement component of claim 25, wherein the release includes a handle adapted to be gripped during replacement of the replacement component where the handle is pivotally repositionable and operative to move the release between the first position and the second position.

28. The replacement component of claim 25, wherein one of the recess and the projection is biased toward the other.

29. An inkjet assembly comprising:

an ink reservoir; and an ink reservoir holder of an inkjet printer;

wherein one of the ink reservoir and the ink reservoir holder includes a projection, while the other of the ink reservoir and the ink reservoir holder includes a recess that is adapted to be occupied by the projection to mount the ink reservoir to the ink reservoir holder; and wherein one of the ink reservoir and the ink reservoir holder includes a release separate from the projection and the recess, the release being operative to selectively contact at least one of the projection and a boundary of the recess to substantially remove the projection from the recess prior to removal of the ink reservoir from the ink reservoir holder.

30. The inkjet assembly of claim 29, wherein the ink reservoir is mounted to a printhead.

31. The inkjet assembly of claim 29, wherein the release is adapted to be repositioned in a first direction and the ink reservoir is adapted to be removed from the ink reservoir holder in the first direction.

32. The inkjet assembly of claim 31, wherein the release includes a handle adapted to be finger gripped by a user and pulled in the first direction to remove the ink reservoir from the ink reservoir holder.

33. The inkjet assembly of claim 29, wherein:

the ink reservoir includes the projection;

the ink reservoir holder includes the recess; and the ink reservoir holder includes the release.

34. The inkjet assembly of claim 33, wherein the release is slidably repositionable with respect to the ink reservoir holder.

35. The inkjet assembly of claim 34, wherein:

the release is slidably repositionable between a first position and a second position;

the first position is adapted to not substantially disengage the projection from the recess; and the second position is adapted to substantially disengage the projection from the recess.

36. The inkjet assembly of claim 35, wherein the release is biased to the first position.

37. The inkjet assembly of claim 35, wherein the release includes a handle adapted to be pushed inward during replacement of the ink reservoir, where the handle is repositionable and operative to move the release between the first position and the second position.

38. The inkjet assembly of claim 35, wherein the release includes a handle adapted to be gripped during replacement of the ink reservoir, where the handle is repositionable and operative to move the release between the first position and the second position.

39. The inkjet assembly of claim 35, wherein one of the recess and the projection is biased toward the other.

40. The inkjet assembly of claim 39, wherein:

the release is pivotally repositionable between a first position and a second position;

the first position is adapted to not substantially disengage the projection from the recess; and the second position is adapted to substantially disengage the projection from the recess.

41. The inkjet assembly of claim 40, wherein the release is biased in the first position.

42. The inkjet assembly of claim 40, wherein the release includes a handle adapted to be gripped during replacement of the ink reservoir, where the handle is repositionable and operative to move the release between the first position and the second position.

43. The inkjet assembly of claim 40, wherein the release includes a handle adapted to be pushed inward during replacement of the ink reservoir, where the handle is repositionable and operative to move the release between the first position and the second position.

44. The inkjet assembly of claim 40, wherein one of the recess and the projection is biased toward the other.

45. The inkjet assembly of claim 33, wherein the release is pivotally repositionable with respect to the ink reservoir holder.

46. The inkjet assembly of claim 29, wherein:

the ink reservoir includes the recess;

the ink reservoir holder includes the projection; and the ink reservoir holder includes the release.

47. The inkjet assembly of claim 46, wherein the release is slidably repositionable with respect to the ink reservoir bolder.

48. The inkjet assembly of claim 47, wherein:

the release is slidably repositionable between a first position and a second position;

the first position is adapted to not substantially disengage the projection from the recess; and the second position is adapted to substantially disengage the projection from the recess.

49. The inkjet assembly of claim 48, wherein the release is biased to the first position.

50. The inkjet assembly of claim 48, wherein the release includes a handle adapted to be gripped during replacement of the ink reservoir, where the handle is repositionable and operative to move the release between the first position and the second position.

51. The inkjet assembly of claim 48, wherein the release includes a handle adapted to be pushed inward during replacement of the ink reservoir, where the handle is repositionable and operative to move the release between the first position and the second position.

52. The inkjet assembly of claim 48, wherein one of the recess and the projection is biased toward the other.

53. The inkjet assembly of claim 46, wherein the release is pivotally repositionable with respect to the ink reservoir holder.

54. The inkjet assembly of claim 53, wherein:

the release is pivotally repositionable between a first position and a second position;

the first position is adapted to not substantially disengage the projection from the recess; and the second position is adapted to substantially disengage the projection from the recess.

55. The inkjet assembly of claim 54, wherein the release is biased in the first position.

56. The inkjet assembly of claim 54, wherein the release includes a handle adapted to be gripped during replacement of the ink reservoir, where the handle is repositionable and operative to move the release between the first position and the second position.

57. The inkjet assembly of claim 54, wherein the release includes a handle adapted to be pushed inward during replacement of the ink reservoir, where the handle is repositionable and operative to move the release between the first position and the second position.

58. The inkjet assembly of claim 54, wherein one of the recess and the projection is biased toward the other.

59. A retention and release mechanism for mounting a first constituent of a printer component to a second constituent of a printer component comprising:

a first printer coupling component including one of a first constituent and a second constituent;

a second printer coupling component including the other of the first constituent and the second constituent; and a release component separate from the first constituent and the second constituent, the release component associated with at least one of the first coupling component and the second coupling component;

wherein interaction between the first constituent and the second constituent is operative to mount the first printer coupling component to the second printer coupling component; and wherein the release component is adapted to be repositioned to reposition the first constituent with respect to the second constituent, thereby allowing the first constituent to be disengaged from the second constituent and allowing the first printer coupling component to be disengaged from the second printer coupling component.

60. The retention and release mechanism of claim 59, wherein:

the first printer coupling component includes an appendage;

the second printer coupling component includes a concavity;

the first printer coupling component includes the first constituent;

the second printer coupling component includes the second constituent; and the release component is associated with the first printer coupling component.

61. The retention and release mechanism of claim 60, wherein:

the first printer coupling component includes an ink reservoir, and the second printer coupling component includes an ink reservoir receptacle.

62. The retention and release mechanism of claim 59, wherein:

the first printer coupling component includes a concavity;

the second printer coupling component includes an appendage;

the first printer coupling component includes the second constituent;

the second printer coupling component includes the first constituent; and the release component is associated with the first printer coupling component.

63. The retention and release mechanism of claim 62, wherein:

the first printer coupling component includes an ink reservoir, and the second printer coupling component includes an ink reservoir receptacle.

64. The retention and release mechanism of claim 59, wherein:

the first printer coupling component includes an appendage;

the second printer coupling component includes a concavity;

the first printer coupling component includes the first constituent;

the second printer coupling component includes the second constituent; and the release component is associated with the second printer coupling component.

65. The retention and release mechanism of claim 64, wherein:

the second printer coupling component includes an ink reservoir receptacle; and the first printer coupling component includes an ink reservoir.

66. The retention and release mechanism of claim 59, wherein the first printer coupling component includes a concavity;

the second printer coupling component includes an appendage;

the first printer coupling component includes the second constituent;

the second printer coupling component includes the first constituent; and the release component is associated with the second printer coupling component.

67. The retention and release mechanism of claim 66, wherein:

the second printer coupling component includes an ink reservoir receptacle; and the first printer coupling component includes an ink reservoir.

68. A method of manipulating the extraction force associated with a replacement component of an inkjet printer, the method comprising the step of:

displacing a retainer operative to maintain the relative position of a first printer component with respect to a second printer component by selectively contacting a mechanical release therewith to disengage the retainer and thereby allowing the first printer component to be repositioned with respect to the second printer component, wherein the mechanical release is associated with one of the first printer component and the second printer component, and wherein the mechanical release is separate from the first printer component and the second printer component.

69. The method of claim 68, wherein the displacing step includes the step of displacing the retainer in a first direction allowing removal of the first printer component from the second printer component.

70. The inkjet assembly of claim 69, wherein the mechanical release includes a handle adapted to be finger gripped by a user and polled in the first direction to remove the first printer component from the second printer component.

71. The method of claim 68, wherein:

the retainer includes a projection associated with the second printer component; and the mechanical release is associated with the first printer component, where the first printer component includes a recess operative to receive the projection therein.

72. The method of claim 71, wherein the mechanical release slides with respect to the first printer component.

73. The method of claim 71, wherein the mechanical release pivots with respect to the first printer component.

74. The method of claim 71, wherein the first printer component includes an ink reservoir; and the second printer component includes an ink reservoir receptacle.

75. The method of claim 68, wherein:

the mechanical release is associated with the second printer component; and the retainer includes a projection associated with the second printer component and a recess associated with the first printer component operative to receive the projection therein.

76. The method of claim 75, wherein the mechanical release slides with respect to the second printer component.

77. The method of claim 75, wherein the mechanical release pivots with respect to the second printer component.

78. The method of claim 75, wherein:

the first printer component includes an ink reservoir; and the second printer component includes an ink reservoir receptacle.

79. The method of claim 68, wherein:

the mechanical release is associated with the first printer component; and the retainer includes a projection associated with the first printer component and a recess associated with the second printer component operative to receive the projection therein.

80. The method of claim 79, wherein the mechanical release slides with respect to the first printer component.

81. The method of claim 79, wherein the mechanical release pivots with respect to the first printer component.

82. The method of claim 79, wherein:

the first printer component includes an ink reservoir; and the second printer component includes an ink reservoir receptacle.

83. The method of claim 68, wherein:

the mechanical release is associated with the second printer component; and the retainer includes a projection associated with the first printer component and a recess associated with the second printer component operative to receive the projection therein.

84. The method of claim 83, wherein the mechanical release slides with respect to the second printer component.

85. The method of claim 83, wherein the mechanical release pivots with respect to the second printer component.

86. The method of claim 83, wherein:

the first printer component includes an ink reservoir; and the second printer component includes an ink reservoir receptacle.

* * * * *